US007752782B2

(12) United States Patent
Peterson et al.

(10) Patent No.: US 7,752,782 B2
(45) Date of Patent: Jul. 13, 2010

(54) BADGE FOR DISPLAYING MULTIPLE AND INTERCHANGEABLE PIECES OF INFORMATION

(75) Inventors: James P. Peterson, Manitowoc, WI (US); Richard C. Haug, Center Moriches, NY (US); Arnold M. Kapitz, Manitowoc, WI (US)

(73) Assignee: Contemporary, Inc., Manitowoc, WI (US)

( * ) Notice: Subject to any disclaimer, the term of this patent is extended or adjusted under 35 U.S.C. 154(b) by 119 days.

(21) Appl. No.: 11/616,376

(22) Filed: Dec. 27, 2006

(65) Prior Publication Data

US 2007/0107275 A1 May 17, 2007

Related U.S. Application Data

(63) Continuation of application No. 11/001,833, filed on Dec. 2, 2004, now Pat. No. 7,194,828.

(51) Int. Cl.
*A44C 3/00* (2006.01)

(52) U.S. Cl. ..... 40/1.5; 40/1.6; 40/661.01; 40/661.04; 40/600; 40/621

(58) Field of Classification Search ..... 40/1.5, 40/1.6, 600
See application file for complete search history.

(56) References Cited

U.S. PATENT DOCUMENTS

| | | | | |
|---|---|---|---|---|
| 584,770 | A | | 6/1897 | Datz |
| 1,483,139 | A | | 2/1924 | Weed |
| 2,012,420 | A | | 8/1935 | Day |
| 2,213,449 | A | | 9/1940 | Mungen |
| 2,232,060 | A | | 2/1941 | Foster |
| 2,341,467 | A | | 8/1944 | Nedell |
| 2,411,987 | A | | 12/1946 | D'Antonio |
| 2,877,578 | A | | 3/1959 | Klitzner |
| 3,605,300 | A | | 9/1971 | Moore |
| 3,642,552 | A | | 2/1972 | Sibley |
| 4,040,194 | A | | 8/1977 | Penton et al. |
| 4,236,331 | A | | 12/1980 | Mattson |
| 4,459,772 | A | | 7/1984 | Kanzelberger |
| 4,509,277 | A | * | 4/1985 | Bolton ..... 40/1.5 |
| 4,531,320 | A | * | 7/1985 | James ..... 40/621 |
| 4,716,052 | A | | 12/1987 | Waugh et al. |
| 4,718,784 | A | | 1/1988 | Drisko |
| 4,869,004 | A | * | 9/1989 | Maloney ..... 40/1.5 |
| 4,946,532 | A | | 8/1990 | Freeman |
| 5,191,682 | A | | 3/1993 | Davis-Reardon et al. |
| 5,210,966 | A | * | 5/1993 | Fuehrer ..... 40/1.5 |

(Continued)

FOREIGN PATENT DOCUMENTS

| | | |
|---|---|---|
| FR | 2694483 | 2/1994 |

*Primary Examiner*—Cassandra Davis
(74) *Attorney, Agent, or Firm*—Michael Best & Friedrich LLP

(57) ABSTRACT

An article to be worn, such as a badge, displays indicia such as identification and advertising. The article includes a housing, a first indicia member positioned on the first indicia portion of the housing and a second indicia member positioned on the second indicia portion of the housing. The first and second indicia portions are discrete from one another and can receive interchangeable indicia members. The invention further includes a method of identifying a wearer of the article, such as a sales clerk or food service preparer, and advertising a product or service, all with the same badge.

6 Claims, 4 Drawing Sheets

U.S. PATENT DOCUMENTS

| | | | | |
|---|---|---|---|---|
| 5,212,899 | A | | 5/1993 | Fandreyer |
| 5,269,083 | A | * | 12/1993 | Vampatella et al. ..... 40/711 |
| 5,269,485 | A | | 12/1993 | Dwinell et al. |
| 5,283,966 | A | | 2/1994 | Rader et al. |
| 5,305,538 | A | | 4/1994 | Kanzelberger |
| 5,369,899 | A | | 12/1994 | Reeves |
| 5,406,726 | A | | 4/1995 | Fan |
| 5,410,827 | A | | 5/1995 | Smith |
| 5,413,383 | A | | 5/1995 | Laurash et al. |
| 5,555,660 | A | | 9/1996 | Whitehouse et al. |
| 5,622,758 | A | | 4/1997 | Hollis et al. |
| 5,647,099 | A | | 7/1997 | Cohen |
| 5,653,472 | A | | 8/1997 | Huddleston et al. |
| 5,719,828 | A | | 2/1998 | Haas et al. |
| 5,740,557 | A | | 4/1998 | Reid et al. |
| 5,770,289 | A | | 6/1998 | Tracy |
| 5,974,230 | A | | 10/1999 | Jenkins |
| 6,013,154 | A | | 1/2000 | Thomas-Cote |
| 6,068,716 | A | | 5/2000 | Higgins |
| 6,095,567 | A | | 8/2000 | Buell |
| 6,136,130 | A | | 10/2000 | Tataryan et al. |
| 6,159,570 | A | | 12/2000 | Ulrich et al. |
| 6,173,514 | B1 | | 1/2001 | Peterson |
| 6,174,402 | B1 | | 1/2001 | Nakano |
| 6,196,593 | B1 | | 3/2001 | Petrick et al. |
| 6,197,396 | B1 | | 3/2001 | Haas et al. |
| 6,254,952 | B1 | | 7/2001 | Fox et al. |
| 6,294,237 | B1 | | 9/2001 | Popat |
| 6,318,757 | B1 | | 11/2001 | Ritchie et al. |
| 6,461,707 | B1 | | 10/2002 | Scholz et al. |
| 6,484,424 | B1 | | 11/2002 | Peterson |
| 6,538,765 | B1 | | 3/2003 | Ikedo |
| 6,585,845 | B1 | | 7/2003 | Peterson |
| 6,594,871 | B2 | * | 7/2003 | Hoffman ..... 24/303 |
| 6,811,840 | B1 | | 11/2004 | Cross |
| 2001/0045037 | A1 | | 11/2001 | Bank et al. |

* cited by examiner

BADGE FOR DISPLAYING MULTIPLE AND INTERCHANGEABLE PIECES OF INFORMATION

RELATED APPLICATIONS

The present application is a continuation of co-pending U.S. patent application Ser. No. 11/001,833, filed Dec. 2, 2004, the entire contents of which are hereby incorporated by reference.

FIELD OF THE INVENTION

This invention relates generally to badges and, more particularly, to badges used like a "wearable billboard" for displaying multiple and interchangeable pieces of information.

BACKGROUND OF THE INVENTION

A large number of badges exist in today's marketplace for displaying identification or other indicia thereon. These typical badges include only a single display area with indicia thereon. Such indicia can include a wearer's name, an identification number, other words, names, symbols, graphics, illustrations or pictures. Badges are used in a variety of environments, such as service, retail, employment, military, educational, and meeting environments. They are most commonly attached to a wearer's clothing through a variety of means such as pins or adhesives.

SUMMARY OF THE INVENTION

In some aspects, the invention provides an article for displaying indicia, the article including a housing, a first indicia bearing member positioned on the housing, and a second indicia bearing member positioned on the housing.

In other aspects, the invention provides a badge including a housing having a first indicia portion and a second indicia portion, the first and second indicia portions being discrete from one another, a first indicia member attached to the first indicia portion of the housing, and a second indicia member attached to the second indicia portion of the housing, the second indicia different than the first indicia.

In yet other aspects, the invention provides a method of identifying a wearer and advertising goods or services with a badge, the method including providing a badge including a housing having a first indicia portion and a second indicia portion, attaching a first indicia member to the first indicia portion of the housing, and attaching a second indicia member to the second indicia portion of the housing.

DETAILED DESCRIPTION

Figure 1:
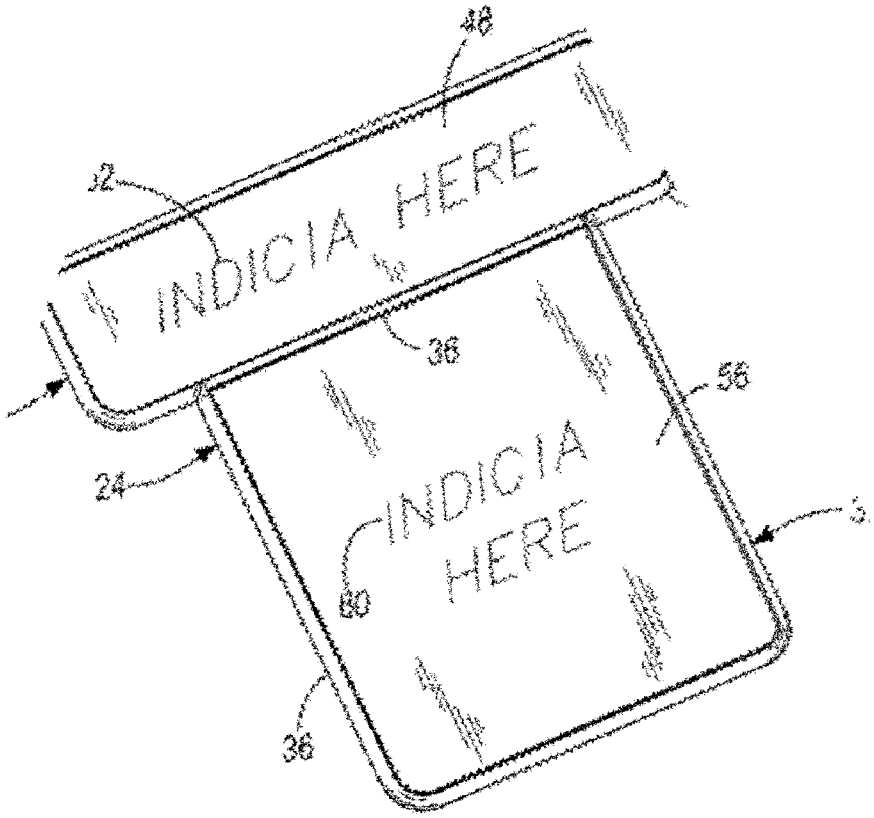
FIG. 1 is a front perspective view of a badge.

With reference to FIG. 1, an article, such as a badge 20, is illustrated and can be worn by a person in various environments, such as, for example a restaurant, a retail store, or by an on-site cable technician, a bus driver, etc., or any other person in an environment in which it is useful for the wearer to display some indicia on his/her person. The indicia, for example, may identify an individual, or advertise, promote or market a service or product. The indicia may comprise, for example, text, pictures, colors, numbers, symbols, illustrations, etc.

Badge 20 includes a housing 24 having a first indicia portion 28 and a second indicia portion 32. The badge 20 can assume a variety of different configurations and can include any number of indicia portions. For example, badge 20 can include three indicia portions. In such an example, one of the indicia portions can be for identification of a person and the other two, for advertising. In the illustrated construction, including only two indicia portions, first indicia portion 28 is used to identify the user of badge 20 and second indicia portion 32 is used for advertising, promoting or marketing purposes to advertise, promote or market a product(s) or service(s). Alternatively, the first indicia portion 28 can be used for advertising, promotional or marketing purposes and the second indicia portion 32 can be used for identification purposes.

Figure 2:
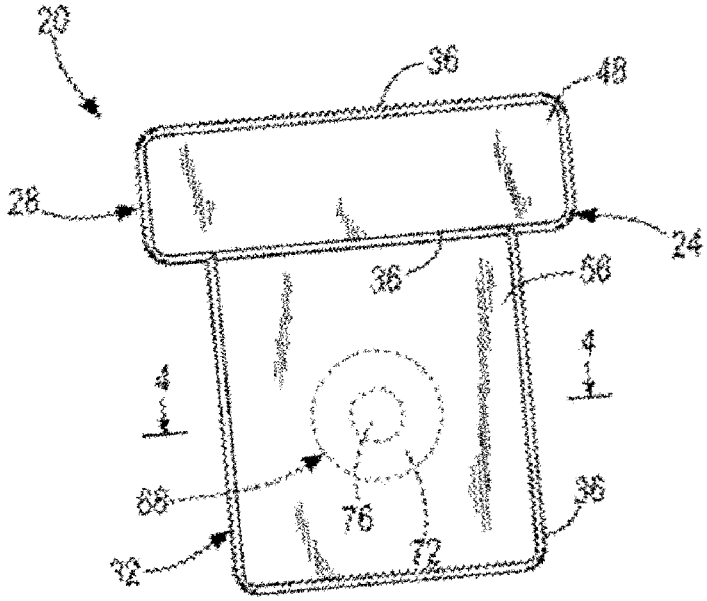
FIG. 2 is a front view of the badge shown in FIG. 1, shown with indicia removed.
Figure 3:
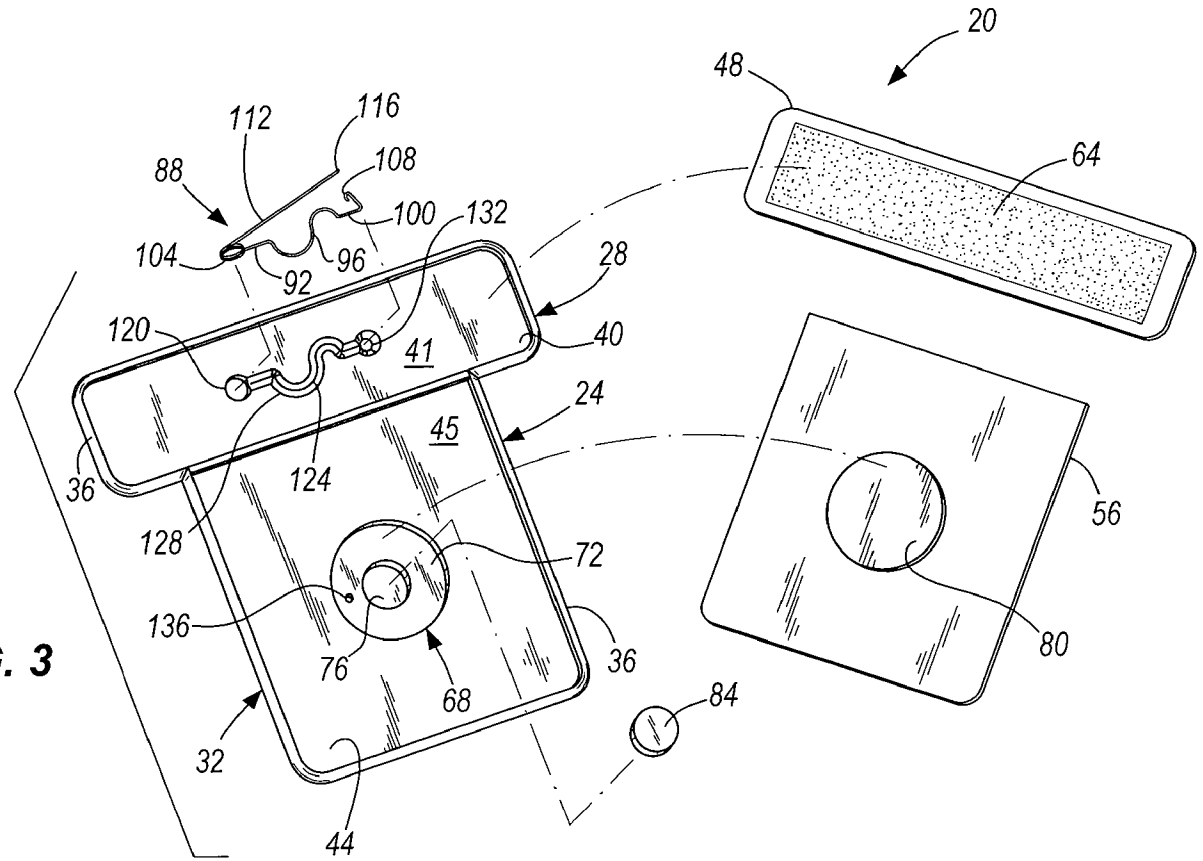
FIG. 3 is an exploded front perspective view of the badge shown in FIG. 1.

With reference to FIGS. 1-4, housing 24 includes a frame 36 extending around and between the first and second indicia portions 28, 32 to discretely separate them and define a first receptacle 40 and a second receptacle 44, corresponding respectively to the first and second indicia portions 28, 32 (see FIG. 3). Badge 20 also includes a first plate 48 containing a first indicia 52 thereon and a second plate 56 containing a second indicia 60 thereon (see FIGS. 1 and 2). The first and second plates 48, 56 are positionable in the first and second receptacles 40, 44, respectively, and are each surrounded by frame 36. The frame 36 assists in proper insertion and alignment of the plates 48, 56 in the first and second receptacles 40, 44 because the plates preferably substantially fill the area, but not necessarily the depth, of the respective receptacles.

Figure 4:
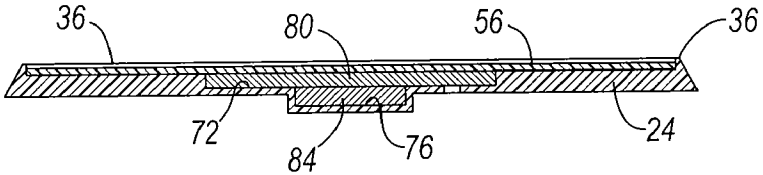
FIG. 4 is a cross-sectional view taken along line 4-4 in FIG. 2.

Referring to FIGS. 2-4, the plates 48, 56 can be either removably or permanently attached to housing 24 within the receptacles 40, 44 in a variety of manners. In the illustrated construction, double-sided adhesive tape 64 is applied to the rear of the first plate 48, which is adhesively attached to floor 41 within the first receptacle 40. In this manner the first plate 48 is removably and adhesively attached to housing 24 and can be removed from the housing 24 to attach another plate to the housing 24 within the first receptacle 40 or for other reasons (discussed in more detail below). Alternatively, the adhesive tape 64 could include the appropriate adhesive properties to permanently attach the first plate 48 to the housing 24, thereby preventing the first plate 48 from being removed and replaced with another plate.

Also in the illustrated construction, the second plate 56 is magnetically attached to the second receptacle 44. A stepped recess 68 is defined in the floor 45 within the second receptacle 44 and includes a first step 72 and a second step 76 concentric with the first step position (see FIGS. 3 and 4). First step 72 lies below floor 45 and second step 76 lies below first step 72. Badge 20 further includes a metallic member 80 capable of magnetic attraction connected to the rear of the second plate 56 and a magnet 84 connected to the housing 24 within the second step 76 of the stepped recess 68. To removably and magnetically attach the second plate 56 to the housing 24, the metallic member 80 is aligned with and fits within the first step 72 of the stepped recess 68, where the magnet 84 magnetically attracts the metallic member 80 thereto and magnetically attaches the second plate 56 to the housing 24. In the illustrated construction, the metallic member 80 and the first step 72 of the stepped recess 68 are complimentarily shaped to assist, in combination with the frame 36, with obtaining the proper orientation and attachment of the second plate 56 to the housing 24. The metallic member 80 and the first step 72 of the stepped recess 68 can assume any appropriate shape, either complimentary or uncomplimentary to each other, so long as the member 80 and magnet 84 can magnetically connect and the second plate 56 lies flat against floor 45. That is, the depths of the first and second steps and the corresponding thicknesses of member 80 and magnet 84 must be such as to permit second plate 56 to lie flush with floor 45. Also, the magnet 84 and the metallic member 80 can be reversed with one another and connected to the other of the second plate 56 and the second step 76 of the stepped recess 68. The magnet 84 and metallic member 80 can be of any shape or size as long as a secure magnetic attachment is made therebetween and maintained during normal use of the badge 20.

The first and second plates 48, 56 can be connected, either permanently or removably, to the housing 24 within the appropriate receptacle 40, 44 in a variety of other manners, such as, for example, gluing, hooks and loop fasteners (Velcro), permanently bonding (i.e., melting), integrally forming, suitable combinations of connecting systems, etc. It should further be understood that the first and second plates 48, 56 can be similarly attached (i.e., both adhesively attached or both magnetically attached) or differently attached (i.e., as illustrated in the figures and described hereinbefore) to the housing 24.

Figure 5:
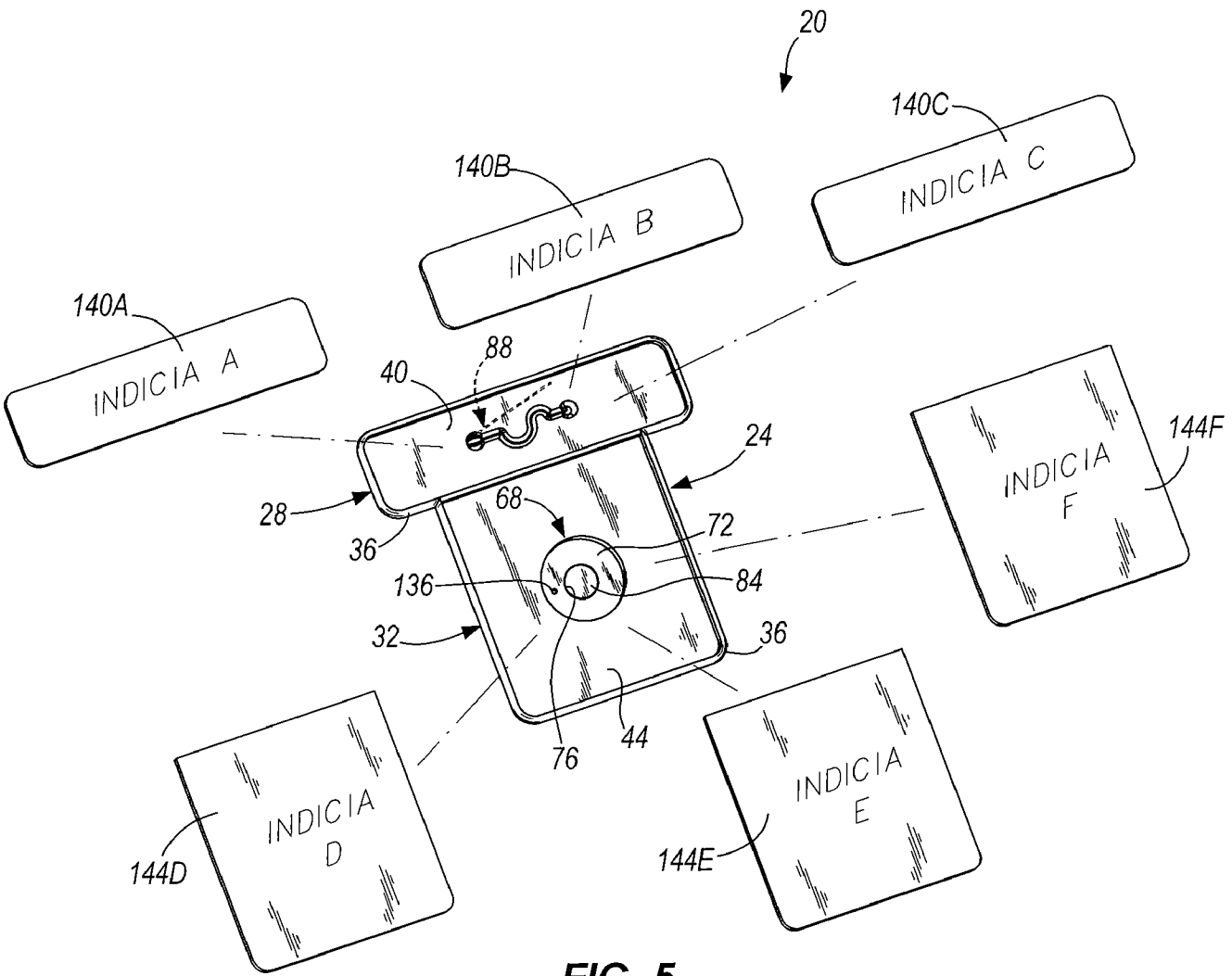
FIG. 5 is an exploded front perspective view of the badge shown in FIG. 1, shown with a plurality of indicia plates exploded from the badge.
Figure 6:
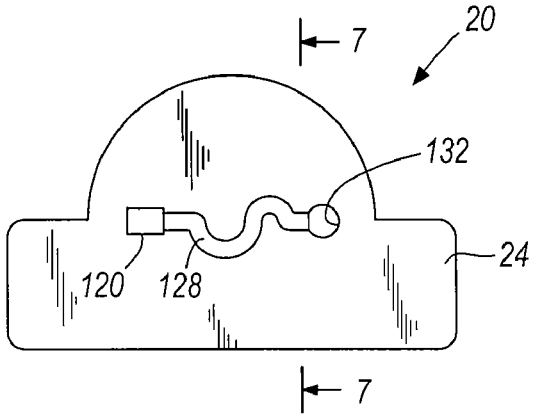
FIG. 6 is a front perspective view of a badge.
Figure 9:
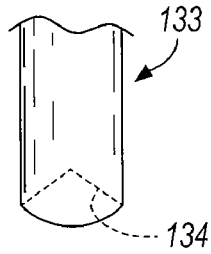
FIG. 9 is a side view of the punch shown in FIGS. 7 and 8.
Figure 7:
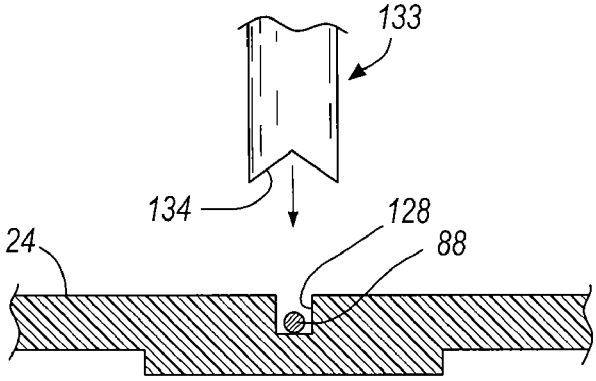
FIG. 7 is a cross-sectional view of the badge taken along line 7-7 in FIG. 6, shown with a punch before it engages the badge.
Figure 8:
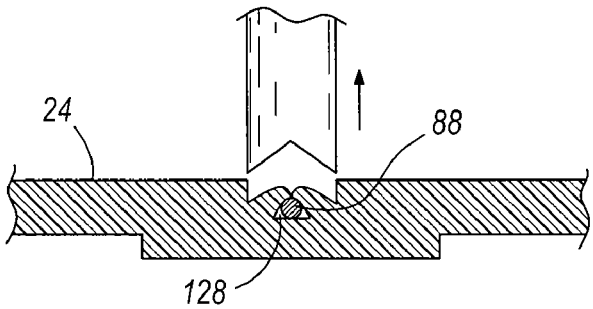
FIG. 8 is a cross-sectional view similar to the cross-sectional view in FIG. 7, shown with the punch after it engages the badge.

Referring particularly to FIGS. 3 and 5, badge 20 includes a pin 88 for attaching badge 20 to clothing of a worker. Pin 88 is formed by bending a wire spring. The pin 88 has a bent profile 92-100 in a horizontal plane and an upstanding spring bend 104 and a hook 108 in a vertical plane. Pin 88 also has a bar 112, pointed on one end 116, which may be inserted through any suitable fabric in order to attach badge 20 to the clothing of a person. At bend 104, the wire spring bends back upon itself to form a spring section, which is reminiscent of a corresponding part of a safety pin. From there, the wire spring has a profile in a horizontal plane and the profile preferably begins with a somewhat straight section 92. The straight section 92 facilitates installation of the pin 88 through a hole 120 defined through the housing 24 in the first receptacle 40. Next, the wire spring forming the pin 88 has an arcuate stabilizing section 96 in a horizontal plane. The arcuate stabilizing section 96 of the pin 88 is similar in shape to an arcuate stabilizing section 124 of a groove 128 defined in the floor 41 of first receptacle 40 of the housing 24. It should be understood that the arcuate stabilizing section 96 of the pin 88 and the groove 128 can have a variety of configurations, as long as the configurations are sufficient to stabilize the pin 88 relative to the housing 24. At the end of the arcuate stabilizing section 96, the wire spring has a straight section 100, again to facilitate insertion of hook 108 through a second hole 132 in the housing 24. The wire spring ends in upstanding hook 108 for receiving and capturing end 116 of bar 112. Attaching the first plate 48 to the housing 24 within the first receptacle 40 secures the pin 88 to the housing 24. Removal of the first plate 48 from the housing 24 allows the pin 88 to be removed from the housing 24.

When the badge 20 is repeatedly attached and removed from the user's clothing, sometimes the pin 88 may form an undesirable impression on the face of first plate 48 caused by the pin's movement relative to the groove 128 in the housing 24. To avoid this from occurring, the pin 88 may be glued or otherwise secured in place so that it will not move during use of the badge 20. When the pin 88 is glued in the groove 128, the pin 88 will not normally be removable.

While gluing is a suitable means for securing the pin in place, it is a labor-intensive step, which is costly. Referring to FIGS. 6-9, another means of securing involves wedging a portion of the plastic material of the housing 24 adjacent the groove 128 over the pin 88 after the pin 88 is placed in groove 128. Wedging the material over the pin 88 secures or pinches the pin 88 in place and prevents the pin 88 from moving within the groove 128. The wedging operation is performed with a punch 133 that includes a tip 134 appropriately shaped to force plastic material of the housing 24 over the pin 88 to secure the pin 88 in the groove 128. The tip 134 can be a variety of shapes as long as the pin 88 is properly wedged within the groove 128. The punch 133 moves toward the housing 24 and the tip 134 engages a portion of the housing 24 on each side of the pin 88 to force a suitable portion of the material of the housing 24 over the pin 88 to secure or pinch the pin 88 within the groove 128. After the punch 133 travels sufficiently toward the housing 24 to secure the pin 88 within the groove 128, the punch 133 moves away from the housing 24 in preparation for the next operation.

Badge 20 can be attached to the wearer's clothing in other ways. For example, badge 20 could be attached by a snap, a clip, a jump ring, hook and loop fasteners, magnetically, a military fastener using a nail and a clutch, a pendant, or the like.

Referring to FIGS. 3 and 4, an aperture 136 is defined in the first step 72 of the stepped recess 68. The aperture 136 allows an object (not shown), such as, for example a pen, a pencil, or any other appropriately sized tool, to insert therethrough and engage and push the metallic member 80, together with the second plate 56 away from the magnet 84. In this way the second plate 56 can be easily removed from the housing 24. In the illustrated construction, the aperture 136 is defined in the first step 72 of the stepped recess 68; however, the aperture 136 can be located elsewhere on the housing 24 so long as a suitable object can be inserted therethrough to engage the second plate 56 and push it away from the housing 24. A similar aperture can be provided in the first indicia portion 28 of the housing 24 to facilitate removal of plate 48 from the first indicia portion 28 of the housing 24 in those instances where the plate 48 is removably attached to the housing 24.

Referring to FIG. 5, badge 20 can receive a plurality of identification plates 140 and a plurality of advertising plates 144, which are removably attached and thereby selectively interchangeable by the user.

For example, person A having his or her name on the identification plate 140A can attach identification plate 140A to the first indicia portion 28 and can attach advertising plate 144D to the second indicia portion 32. The following day, person A can remove advertising plate 144D from the housing 24 and attach advertising plate 144E to the housing 24. Indicia D and E may be different forms of advertising for the same product or advertising for different products. In this example, badge 20 is used to identify the same person and the advertising plates 144 are interchangeable to change the advertising performed by badge 20.

In another example, several people can use the badge 20 to advertise the same product. In such an example, identification plate 140A can be attached to the housing 24 for person A and advertising plate 144F can be attached to the housing 24. If person B needs to use the badge 20, person B removes identification plate 140A from the housing 24 and attaches identification plate 140B to the first indicia portion 28. Advertising plate 144F remains attached to the housing 24 and, therefore, person B is advertising the same product as person A using the same badge 20. Any member of suitable combinations can be achieved among several people according to the desires and needs of the employers of these people.

In yet another example, multiple workers can use badge 20 to advertise a plurality of advertisements. This example is a combination of the two previously explained examples in that the identification plates 140 are interchanged between two workers and the advertising plates 144 are interchanged to advertise various advertisements.

Although particular constructions of the present invention have been shown and described, other alternative constructions will be apparent to those skilled in the art and are within the intended scope of the present invention.

What is claimed is:

1. An article for attachment to another object and for displaying indicia, the article comprising:

a housing, said housing having two discrete areas, the two discrete areas each defining a floor that faces forwardly when the article is attached to the other object;

a first indicia bearing member being removably positioned within and engaging the floor of one of said discrete areas on the housing;

a second indicia bearing member being removably positioned within and engaging the floor of the other of said discrete areas on the housing;

a pin for attaching the article to the other object, wherein one of the discrete areas on the housing defines, relative to the floor, one of a projection and a recess, and one of the first and second indicia bearing members defines the other of a projection and a recess, and wherein the projection is received by the recess when the one of the first and second indicia bearing members is removably positioned within the one of the discrete areas on the housing; and wherein the housing is provided with a groove, the pin includes a portion thereof for fitting into the groove, and the pin is stabilized in the groove so that it will not move relative to the groove during use of the article.

2. The article of claim 1, wherein the second indicia bearing member includes the one of the projection and the recess, and wherein the first indicia bearing member is adhesively attachable to the housing and the second indicia bearing member is magnetically attachable to the housing.

3. The article of claim 1, wherein one of the housing and the second indicia bearing member includes a magnet and the other of the housing and the second indicia bearing member is at least partially metallic to enable magnetic attachment between the housing and the second indicia bearing member.

4. The article of claim 1, wherein the pin is stabilized by gluing it into the groove.

5. The article of claim 1, wherein the pin is stabilized by wedging the plastic material adjacent the groove in the housing over the pin after it is placed in the groove.

6. The article of claim 5, wherein the wedging of the plastic is performed by a punch.

* * * * *